US006397956B1

(12) United States Patent
Esposito

(10) Patent No.: US 6,397,956 B1
(45) Date of Patent: Jun. 4, 2002

(54) DIRECTIONAL DRILLING TOOL

(75) Inventor: Giuseppe Esposito, Ortona (IT)

(73) Assignee: SE S.r.l., Ortona (IT)

( * ) Notice: Subject to any disclaimer, the term of this patent is extended or adjusted under 35 U.S.C. 154(b) by 0 days.

(21) Appl. No.: 09/529,539

(22) PCT Filed: Oct. 9, 1998

(86) PCT No.: PCT/EP98/06493

§ 371 (c)(1),
(2), (4) Date: Jun. 14, 2000

(87) PCT Pub. No.: WO99/19596

PCT Pub. Date: Apr. 22, 1999

(30) Foreign Application Priority Data

Oct. 15, 1997 (IT) ..... PE97A0022
Feb. 25, 1998 (GB) ..... 9804020

(51) Int. Cl.[7] ..... E21B 4/14; E21B 10/36
(52) U.S. Cl. ..... 175/296; 175/417; 175/414
(58) Field of Search ..... 175/71, 293, 295, 175/296, 385, 407, 414, 415, 417

(56) References Cited

U.S. PATENT DOCUMENTS 3,269,470 A * 8/1966 Kelly ..... 175/426
4,084,646 A 4/1978 Kurt
4,530,408 A * 7/1985 Toutant ..... 173/17
4,729,439 A 3/1988 Kurt
4,878,547 A 11/1989 Lennon
4,962,822 A * 10/1990 Pascale ..... 175/258
5,052,503 A * 10/1991 Lof ..... 175/258
5,174,390 A * 12/1992 Kurt ..... 175/53

FOREIGN PATENT DOCUMENTS

EP 0 343 800 11/1989
WO WO-90/15220 A1 * 12/1990

* cited by examiner

*Primary Examiner*—David Bagnell
*Assistant Examiner*—Jennifer R. Dougherty
(74) *Attorney, Agent, or Firm*—McDermott, Will & Emery

(57) ABSTRACT

A rotary-percussion device for directional drilling in rock comprises a substantially cylindrical, rotatable body portion (15) housing a percussion hammer, and a frustroconical head (2) eccentrically mounted on the front of the body portion. The minimum diameter face (3) of the head is adjacent to the body portion. The axis (6) of the head is parallel to but offset from the axis (5) of the body. The front face (4) of the head is chisel-shaped and comprises at least one oblique plane (11) sloping forwardly in the same direction as the offset of the head axis relative to the body axis.

9 Claims, 5 Drawing Sheets

DIRECTIONAL DRILLING TOOL

This invention relates to a directional drilling tool, and more particularly to a rotary-percussion device for directional drilling in rock.

A conventional drill for use in rock comprises a drill rod with a drilling head having a roller bit, which comprises three toothed conical steel elements with welded-on hard-metal (e.g. tungsten carbide) tips. The drill rod is hollow and during drilling a flushing liquid (referred to as "drilling mud") is pumped through the rod, exits around the roller bit and travels back through the drill hole. Attempts have been made to recycle drilling mud, but this requires complex filtration equipment, and disposal of drilling mud presents environmental problems.

Directional drilling in rock, in particular horizontal drilling, may employ a combination of rotary and percussion devices. The percussion device may be a pneumatically operated percussion hammer. Such devices may employ a wedge-shaped head. For straight-line drilling, the head is caused to rotate, and the rock is drilled by a combination of the rotary and percussive actions, together with a forward pushing action on the drilling tool. If rotation is stopped, the percussive and pushing actions cause the tool to describe a forward curve in view of its wedge-shaped head. Such tools commonly include an electronic transmitter (sonde) or the like, which cooperates with a receiver above ground for continuously determining the position and direction of the tool.

A common procedure is to first drill a pilot bore. This bore may then be widened to accommodate pipes. cables etc. which are to pass through it. Widening may be carried out by "backreaming", i.e. passing a tool ("reamer") backwards through the pilot bore. A compacting reamer is a wedge- or cone-shaped tool which can be pulled back through the pilot bore, optionally with rotation. A "fly" reamer is a tube or rod with external blades, which is pulled back through the pilot bore, also with rotation. Compacting reamers are generally unable to work in rock, and fly reamers can be slow to cut away at hard rock. Attaching a percussive hammer with compacting reamers to the drill rod for backreaming is known, but is only effective in soft ground.

An object of the present invention is to provide a complete drilling tool which is shaped and constructed in such a way as to provide a particularly effective directional drilling and backreaming action in rock or similar hard media.

The present invention provides a rotary-percussion device for directional drilling and backreaming in rock. For pilot bore drilling it comprises a substantially cylindrical, rotatable body portion housing a percussion hammer, and a frustoconical head eccentrically mounted on the front of the body portion, wherein the minimum diameter face of the head is adjacent to the body portion, the axis of the head is parallel to but offset from the axis of the body, and the front face of the head is chisel-shaped and comprises at least one oblique plane sloping forwardly in the same direction as the offset of the head axis relative to the body axis.

An airline preferably passes through the body and optionally through the head, exiting on the front face of the body or the head in the forwardmost half thereof. In use of the device, pressurised air passes through this airline, exits at the front face and passes back through the drill hole, carrying with it broken fragments of rock and soil (cuttings). The use of drilling mud is accordingly avoided.

The head may be integral with a neck portion which is slidingly received in a forwardmost part of the body. A plurality of hard studs (for example of tungsten carbide) is preferably arranged on the front face of the head, at least in the forwardmost half thereof.

Longitudinally extending, peripheral slots or grooves may be present in the head, to form an interrupted cutting face and to allow the passage of air or cuttings.

The front face of the head may comprise a single flat surface which forms an oblique plane, the forwardmost side of which is offset from the centre in the same direction as the offset from the body axis to the head axis. Alternatively, the front face of the head may comprise a non-oblique or only slightly oblique, forwardmost portion on the offset side, and a more oblique portion on the side remote from the offset.

Reference is now made to the accompanying drawings, in which.

Figure 1:
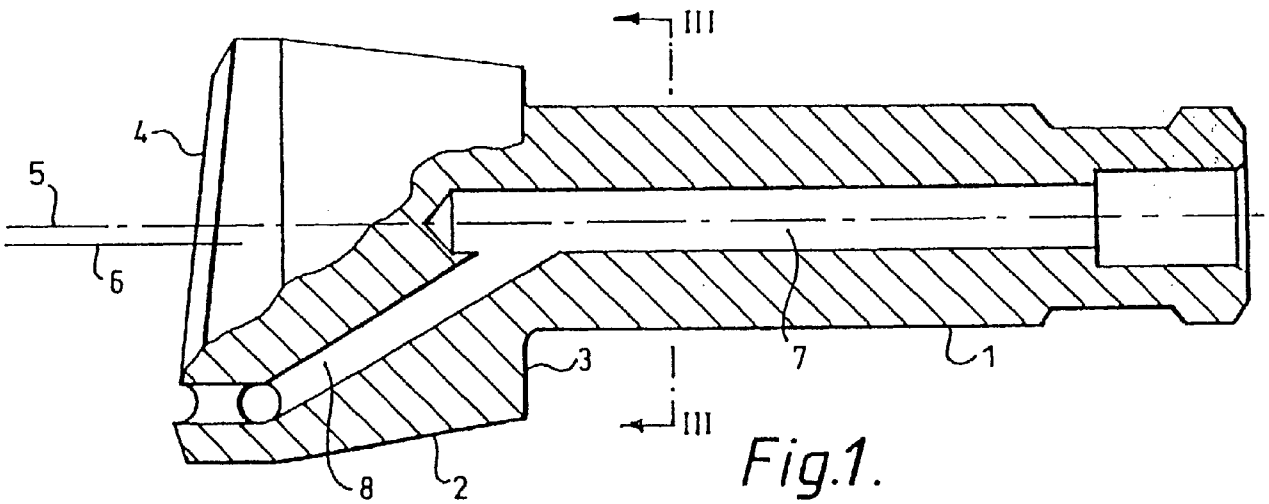
FIG. 1 is a side view, partly in section, of a head and neck portion of a rotary-percussion tool according to an embodiment of the invention.
Figure 2:
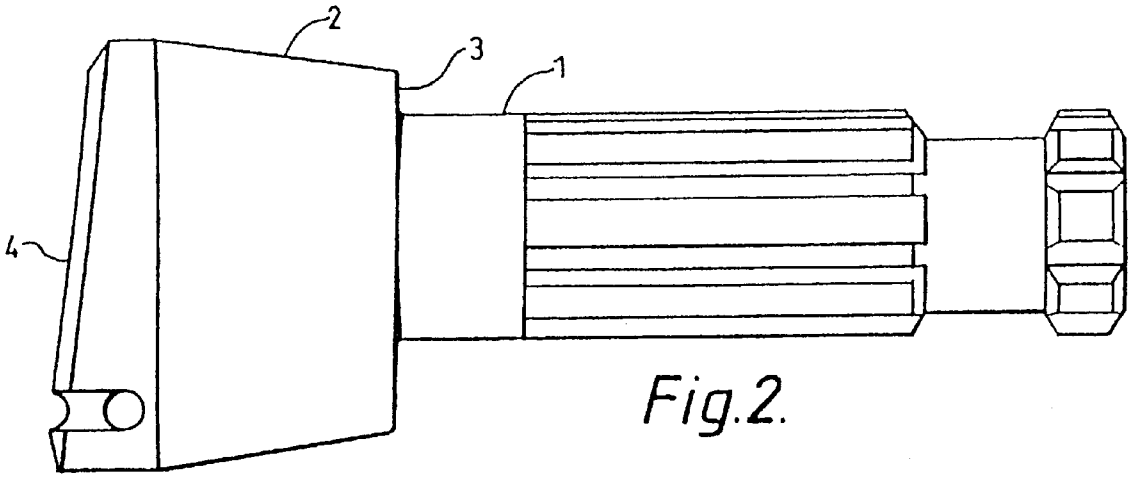
FIG. 2 is a side elevation corresponding to FIG. 1.
Figure 3:
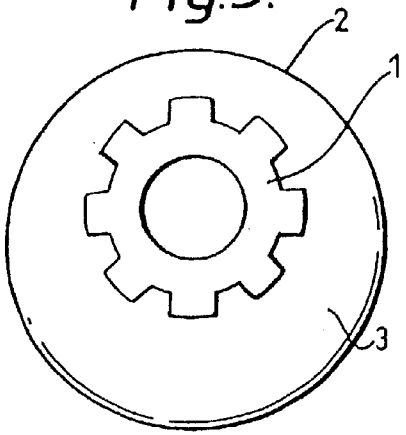
FIG. 3 is a transverse section on the line III—III of FIG. 1.

FIGS. 1, 2 and 3 show a frustoconical head 2 and integral neck portion 1. The neck portion 1 is slidingly received in a tubular forwardmost part of the body portion (not shown) which in turn houses a percussion hammer and radio-detection device or sonde, the latter being insulated against vibration. The sonde is generally cylindrical in shape, and housed in a longitudinal chamber. A compression spring is arranged between each end of the sonde and the adjacent end wall of the chamber so as to protect against vibration. The frustoconical head 2 has a minimum diameter end face 3 which adjoins the neck portion 1, and a maximum diameter end face 4 which forms the front face of the tool. The longitudinal axis 5 of the neck portion 1 (which is colinear with the longitudinal axis of the body portion) and the longitudinal axis 6 of the frustoconical head 2 are parallel to but offset from each other, so the head 2 is eccentrically mounted on the front of the neck portion 1 (and hence the body portion). The axis 6 of the head is in between the axis 5 and the periphery of the neck portion. The displacement of the head axis 6 from the body axis 5 is preferably in the range of from 15 to 93%, more preferably 20 to 80%, of the external radius of the neck portion 1. The radius of the face 3 of the head is preferably from 115 to 225%, more preferably 125 to 200%, and the radius of the face 4 of the head is preferably from 152 to 230%, more preferably 170 to 210%, based in each case on the radius of the neck portion. The angle of inclination of the sides of the frustoconical head 2 is preferably from 0 to 30°, more preferably 5 to 25°.

The front face 4 of the head 2 is chisel-shaped. Thus, the face 4 is formed as an oblique plane which slopes forwardly in the same direction as the offset of the head axis 6 relative to the body axis 5. The forwardmost part of the front surface 4 thus adjoins the part of the periphery of the head 2 which has the greatest displacement from the axis 5 of the body portion.

An airline 7 passes longitudinally through the neck portion 1, transmitting air from the body portion, and communicates with an airline 8 passing through the head 2 and exiting on the face 4. The exit of the airline 8 on the face 4 is close to the periphery in the forwardmost part thereof. When the tool is in operation, pressurised air passes through the airline 7,8 and exits on the front face 4.

As an alternative, the air line(s) may terminate at the front of the body portion. Longitudinally extending, peripheral slots or grooves 16 are then present in the head, for passage of air forwardly and cuttings rearwardly (as shown in FIGS. 6 to 9). The slots or grooves preferably widen towards the rear (as in FIGS. 6 and 7), so as to present blockage by cuttings.

The neck portion 1 and head 2 are made of hardened steel. The front face 4 of the head carries a number of protruding studs of tungsten carbide. The studs are present at least in the forwardmost half of the front face 4, but may also be present over the whole of the face 4.

The oblique face 4 preferably forms an angle with a surface normal to the axis 6 of from 5 to 45°, preferably from 7 to 30°.

The outer surface of the neck portion 1 is longitudinally castellated, for engagement with internal protuberances in a forwardmost tubular part of the body portion (not shown).

Figure 4:
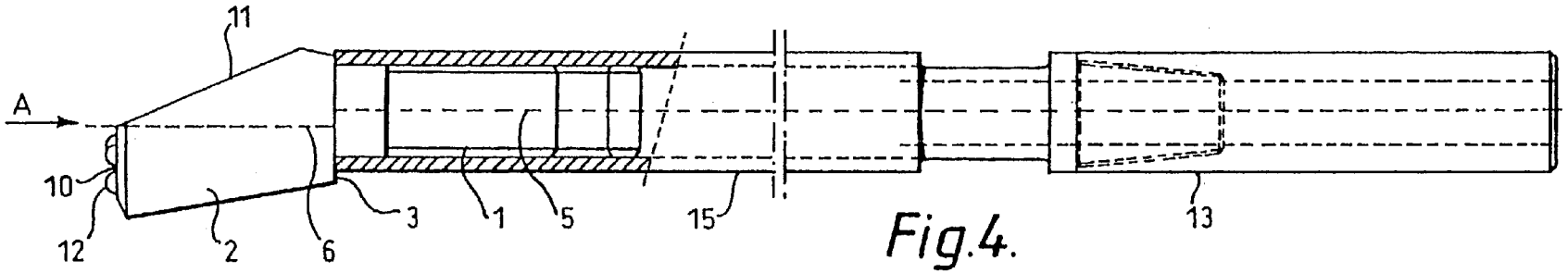
FIG. 4 is a side view, partly in section, of another embodiment of rotary-percussion device according to the invention.
Figure 5:
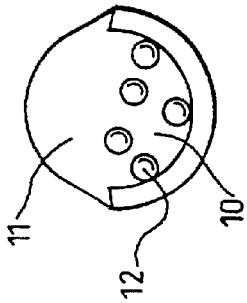
FIG. 5 is an end view corresponding to FIG. 4.
Figure 6:
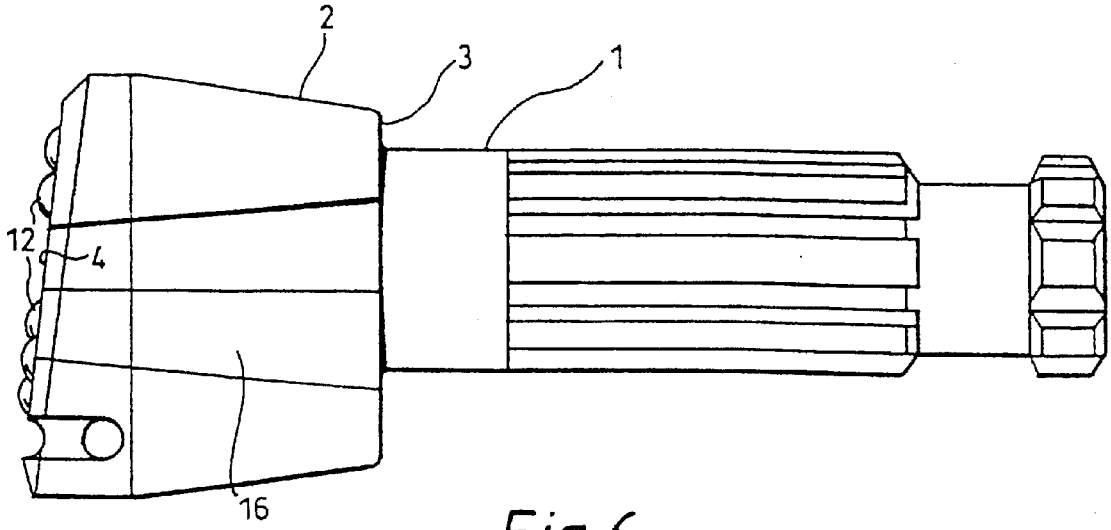
FIG. 6 is a side view of a further embodiment of the head and neck portion.
Figure 7:
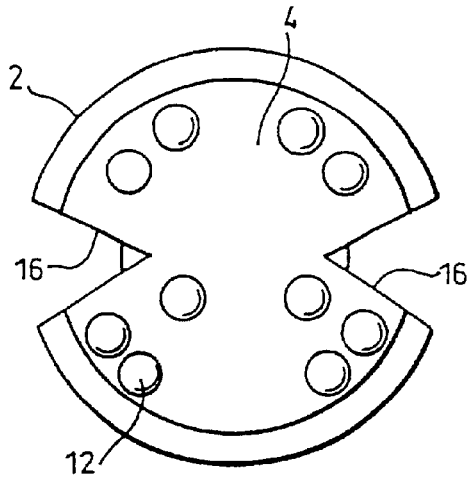
FIG. 7 is a front view corresponding to FIG. 6.
Figure 8:
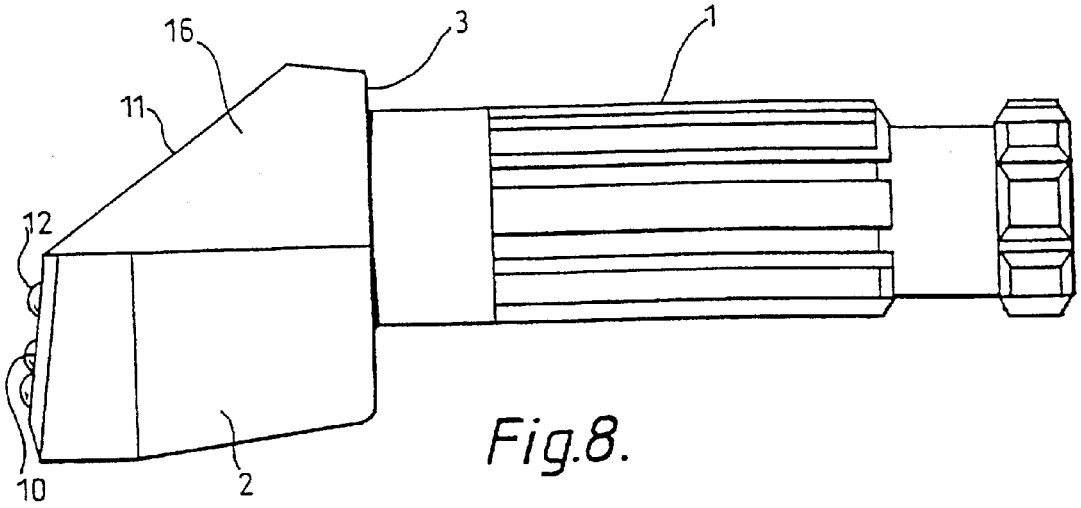
FIG. 8 is a side view of a still further embodiment of the head and neck portion.
Figure 9:
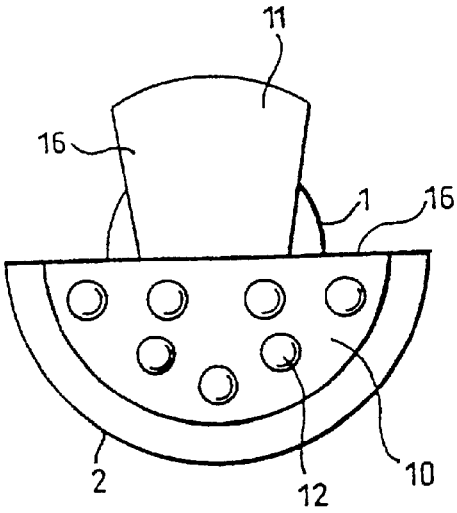
FIG. 9 is a front end view corresponding to FIG. 8.

An alternative embodiment is shown in FIGS. 4 and 5, in which corresponding parts have the same numbers as in FIGS. 1, 2 and 3. Again, a frustoconical head 2 is eccentrically mounted on the front of a cylindrical body portion 15 by means of an integral neck 1 slidingly received in the tubular front part of the body portion 15. However, in this case the front face of the head 2 comprises a non-oblique surface 10 and an oblique surface 11 (these features are also present in FIGS. 8 and 9). The non-oblique surface 10 is the forwardmost part of the head and constitutes approximately half of the front surface on the side of the offset of the head axis 6 relative to the body axis 5. The oblique surface 11 constitutes a cut-away portion which slopes backwardly from the surface 10 to the periphery of the head 2, and forms an angle with a plane normal to the axis 6 of from 5 to 45°, preferably from 7 to 30°. Tungsten carbide studs 12 are present at least on the surface 10. An airline is also present as before, but not shown in FIGS. 4 and 5. The body portion 1 houses a percussion hammer, and is joined to a rear body portion 13 which houses a radio-detection device.

In the use of the tool according to the invention, drilling is achieved by cooperation of three forces: rotation, percussion and pushing action. Steering is achieved by reducing or stopping the rotating action. The tool makes it possible for the first time to achieve directional drilling through rock and other hard materials without the use of drilling mud or similar liquids.

As shown in FIG. 4, the tubular body part 15 is in a forwardmost position, and abuts the rear face 3 of the head. Percussive and pushing actions are transmitted to the head in this position. When drilling through softer ground, the tubular body part retracts so that it no longer abuts the rear face of the head. However, the head is still caused to rotate in this position. The head thus effectively "floats" in the body portion.

The present view of those skilled in the art is that control during drilling, especially rock drilling, using air in place of wet drilling fluids such as water/bentonite mixes is not possible, because the heat generated by the hammering and drilling actions causes the radio sonde to overheat and expire, therefore leaving the drilling rig without a guidance system. Generally sondes currently available must not be exposed to temperatures exceeding around 85° C. The temperatures reached by compressing the air and passing it through the drill rods and sonde housing and the heat generated by the drilling actions are currently believed to be far in excess of the limits of the sonde. It is a fact that the air increases in temperature the more it is compressed and further increases due to the friction when passed through the system. However, when expanded the air reduces in temperature rapidly and if not controlled can reach temperatures below freezing very rapidly.

A feature of this invention is to use the compressed air to cool the sonde and this is done by having a chamber around the sonde larger than the bore of the air supply holes. Thus, when the hot compressed air passes through the holes to the chamber it expands and chills rapidly. The temperature can be controlled by reducing or enlarging either the air supply hole or the chamber around the sonde.

Figure 11:
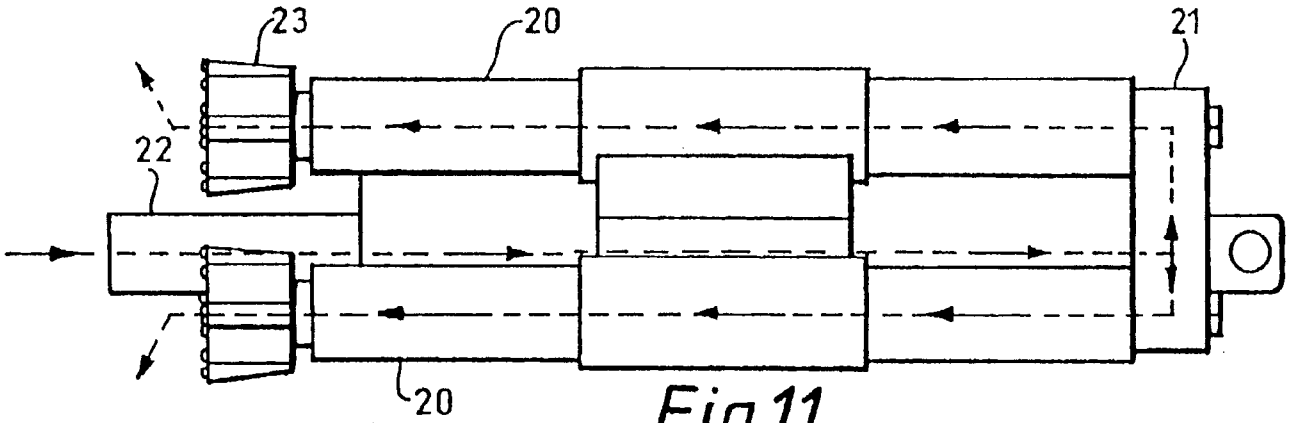
FIGS. 10, 11 and 12 are respectively a front end view, side view and rear end view of a backreaming tool according to an embodiment of the invention.
Figure 12:
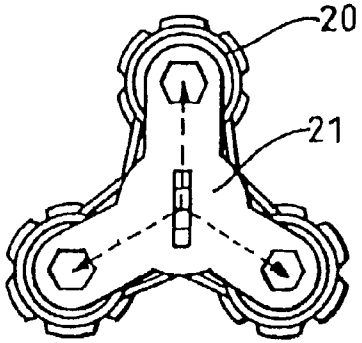
Figure 10:
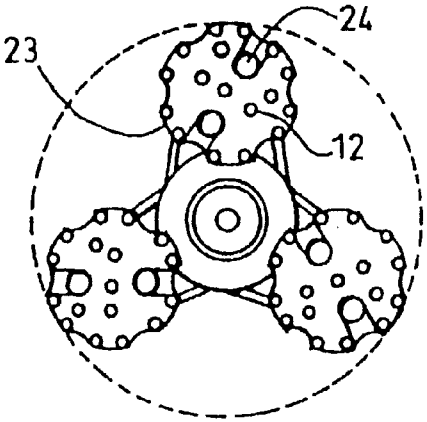

FIGS. 10, 11 and 12 show how backreaming is achieved in an embodiment of the present invention. Two or more percussion hammers 20 are attached via a manifold 21 to the drill rod 22. The hammers have heads 23 with flat front faces, in contrast to the chisel-shaped front faces previously described, as steering is not necessary at this stage. An airline exits at an opening 24 on the front face, which is provided with hardened studs 12 as before. The cutting heads and air system cut away the rock and remove the cuttings from the bore. The bore is thus widened, thereby permitting the installation of a larger pipe or cluster of pipes and/or cables than would have been permitted by the pilot bore.

What is claimed is:

1. A rotary-percussion device for directional drilling in rock comprising:

a frustoconical head;

a neck portion integral with the head; and a substantially cylindrical, rotatable body having a tubular forwardmost part, the head being eccentrically mounted to a front of the body with the neck portion slidingly received in the tubular forwardmost part of the body, wherein the head includes a front face and a rear face, the rear face is adjacent to the forwardmost part of the body, no portion of the body extends forward of the rear face, the axis of the head is parallel to, but offset from the axis of the body, and the front face of the head is chisel-shape and includes at least one oblique plane sloping forwardly in the same direction as the offset of the head axis relative to the body axis.

2. The rotary-percussion device according to claim 1, further comprising an airline which passes through the body and optionally through the head, exiting on the front face of the body or the head.

3. The rotary-percussion device according to claim 2, wherein the airline in a fowardmost half of the front fact of the head.

4. The rotary-percussion device according to claim 2, wherein longitudinally extending, peripheral slots or grooves are present in the head to form an interrupted cutting face and to allow the passage of air or cuttings.

5. The rotary-percussion device according to claim 1, further comprising a plurality of hard studs on the front face of the head.

6. The rotary-percussion device according to claim 1, wherein the front face of the head consists essentially of a single flat surface which forms an oblique plane, the forwardmost side of which is offset from the center in the same direction as the offset of the head axis relative to the body axis.

7. The rotary-percussion device according to claim 1, wherein the front face of the head has a non-oblique, forwardmost portion on the side of the offset of the head axis relative to the body axis, and an oblique portion on the side remote from the offset.

8. The rotary-percussion device according to claim 1, wherein the body is in two parts, a forward portion having a housing and a rear portion having a housing.

9. The rotary-percussion device according to claim 1, wherein a radius of the front face is from about 152% to about 230% of a radius of the neck portion, and a radius of the rear face is from about 115% to about 225% of the radius of the neck portion.

* * * * *